US007168105B2

(12) United States Patent
Adelman

(10) Patent No.: US 7,168,105 B2
(45) Date of Patent: Jan. 30, 2007

(54) CONVERTIBLE MULTI-USE WRITING INSTRUMENT

(76) Inventor: Gregory M. Adelman, 1502 Upland Ave., Boulder, CO (US) 80304

( * ) Notice: Subject to any disclaimer, the term of this patent is extended or adjusted under 35 U.S.C. 154(b) by 372 days.

(21) Appl. No.: 10/819,251

(22) Filed: Apr. 6, 2004

(65) Prior Publication Data

US 2005/0175396 A1 Aug. 11, 2005

Related U.S. Application Data

(60) Provisional application No. 60/537,607, filed on Jan. 20, 2004.

(51) Int. Cl.
*B43K 23/00* (2006.01)

(52) U.S. Cl. ..... 4/95; 401/195

(58) Field of Classification Search ..... 401/17, 401/18, 22, 34, 48, 91, 95, 52, 195
See application file for complete search history.

(56) References Cited

U.S. PATENT DOCUMENTS 692,009 A * 1/1902 Gilbert ..... 401/247
1,546,715 A * 7/1925 Calvento ..... 401/195
2,318,171 A * 5/1943 Lipic, Jr. ..... 401/98
3,174,461 A 3/1965 Pompa
4,317,638 A 3/1982 Klaber ..... 401/195
4,558,966 A 12/1985 Mikuteit ..... 401/213
4,833,902 A 5/1989 Mori ..... 70/456
4,974,982 A 12/1990 Nielson ..... 401/195
5,957,608 A 9/1999 Matsumoto et al. ..... 401/202
6,264,389 B1 7/2001 Ducharme ..... 401/116
2003/0152412 A1 8/2003 Rosso ..... 401/131

* cited by examiner

*Primary Examiner*—Huyen Le
(74) *Attorney, Agent, or Firm*—Baker Botts L.L.P.

(57) ABSTRACT

In one embodiment, a convertible multi-use writing instrument includes a quick-use arrangement including a quick-use writing instrument and a quick-use cap for encapsulating the quick-use writing instrument. The quick-use arrangement is convertible to a full-size arrangement. The convertible multi-use writing instrument also includes the full-size arrangement. The full-size arrangement includes a full-size writing instrument that is convertible to the quick-use arrangement.

13 Claims, 4 Drawing Sheets

CONVERTIBLE MULTI-USE WRITING INSTRUMENT

RELATED APPLICATION

This application claims the benefit, under 35 U.S.C. § 119(e), of U.S. Provisional Application No. 60/537,607 filed Jan. 20, 2004.

TECHNICAL FIELD OF THE INVENTION

This invention relates generally to writing instruments and more particularly to a convertible multi-use writing instrument.

BACKGROUND

A compact/portable pen typically has a writing pen that is very short, requires multiple operations before it is useable to write, and/or converts to a full-size pen with undesirable features such as telescoping tubular sections that look like expanded antennas or with visible signs (such as exposed parts of fasteners) that the full-size pen was converted from the compact pen. Typical full-size pens have the disadvantage of not being with the user when needed since they are not typically attached to a key ring or other object that a person would often carry with them.

SUMMARY OF THE INVENTION

According to the present invention, disadvantages and problems associated with writing instruments may be reduced or eliminated.

In one embodiment, a convertible multi-use writing instrument includes a quick-use arrangement including a quick-use writing instrument and a quick-use cap for encapsulating the quick-use writing instrument. The quick-use arrangement is convertible to a full-size arrangement. The convertible multi-use writing instrument also includes the full-size arrangement. The full-size arrangement includes a full-size writing instrument that is convertible to the quick-use arrangement.

Particular embodiments of the present invention may provide one or more technical advantages. As an example, particular embodiments provide two writing instruments (which may collectively be referred to as a "pen system") in one compact package that may hang from a key chain. One of these two writing instruments may be a quick-use pen readily available for use when needed for quick tasks such as writing a check or jotting down a note or a phone number. This quick-use pen may be easily converted to a full-size pen that may be used for any typical pen application. In particular embodiments, the pen system fits nicely on a key chain in a longitudinally compact state. Because people typically have their keys with them at most, if not all, times, the pen system may alleviate one or more problems a person may encounter as a result of not having a writing instrument when one is needed.

In particular embodiments, the pen system provides a readily available, quick-use pen for quick uses that requires no operation other than pulling the quick-use pen from its cap and placing the quick-use pen back into the cap after use. Particular embodiments provide, within one compact package, two pens: a quick-use pen and a full-size pen (after conversion). In particular embodiments, the quick-use pen readily converts to a full-size pen that has the features, look, and feel of a noncollapsible full-size pen. In particular embodiments, the full-size pen looks and feels like a high-quality pen, with no indication that it may be converted back to a quick-use pen. In particular embodiments, as a result of the quick-use pen, use of a writing instrument does not require multiple or cumbersome operations.

In particular embodiments, the pen system provides a collapsible, compact pen that is convertible to a full-size pen with normal pen features. In particular embodiments, the pen system may be enjoyed by a user as a gadget. The user may know how to convert the pen system from a quick-use pen to a full-size pen and back, while others may be unfamiliar with converting the pen system from a quick-use pen to a full-size pen and back. In particular embodiments, the pen system may be manufactured using different types of materials and colors of finish, which may enable a user to own multiple pen systems and interchange the parts to create unique-looking pens with multiple finishes. These embodiments may provide a marketing advantage in that users may be encouraged to purchase more than one pen for personal use. In particular embodiments, the pen system may accommodate standard-size mini ink cartridges. These embodiments may reduce costs associated with manufacturing, since a custom-size ink cartridge need not be developed for the pen system. In particular embodiments, the pen system may also accept ink cartridges having nonstandard sizes, which may be smaller or larger than standard-size ink cartridges. In particular embodiments, the pen system may use a standard-size pressurized ink refill (which may enable writing in a variety of environmental conditions and even upside down) suitable for different applications of the pen system.

In particular embodiments, the pen system allows a user to have a full-size, standard pen in extreme or unusual situations and locations. In particular embodiments, the pen system collapses into a compact, environment-proof enclosure that a user may take into extreme environmental conditions where a nonsealed pen without a protective housing would be damaged. A full-size pen, quick-use pen, or both may be needed at the user's destination or along the way to the user's destination. In particular embodiments, the pen system may be carried by lifeguards and others working in a marine environment. In particular embodiments, the pen system may travel in a compact state to locations where a full-size pen may be needed, but would be cumbersome to carry, such as in a pocket when the user is bicycling or running. A user may want an environmentally sealed pen system that is compact and durable for a camping or other type of trip and provides a full-size pen that could be used for extensive writing, field notes, or journaling. In particular embodiments, the pen system may include simple mechanical components and designs, which may reduce costs associated with manufacturing the pen system and provide a pen system that is easy to operate, aesthetically pleasing, substantially trouble free, and durable.

Certain embodiments may provide all, some, or none of these technical advantages. Certain embodiments may provide one or more other technical advantages, one or more of which may be readily apparent to those skilled in the art from the figures, descriptions, and claims herein.

BRIEF DESCRIPTION OF THE DRAWINGS

To provide a more complete understanding of the present invention and the features and advantages thereof, reference is made to the following description, taken in conjunction with the accompanying drawings, in which.

DESCRIPTION OF EXAMPLE EMBODIMENTS

Figure 1:
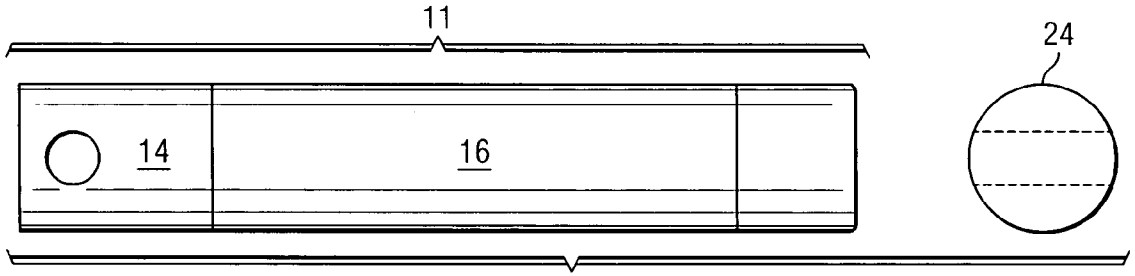
FIG. 1 illustrates a writing instrument in a collapsed state.
Figure 2:
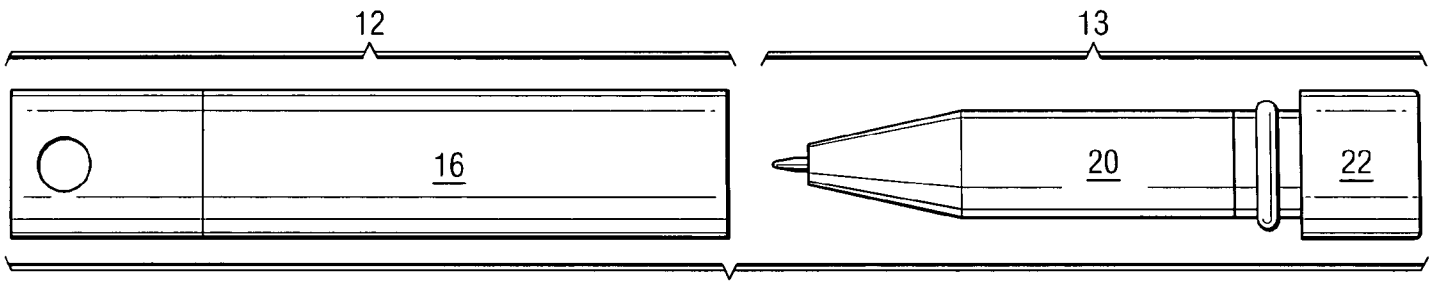
FIG. 2 illustrates a quick-use pen of the writing instrument removed from a cap.
Figure 3:
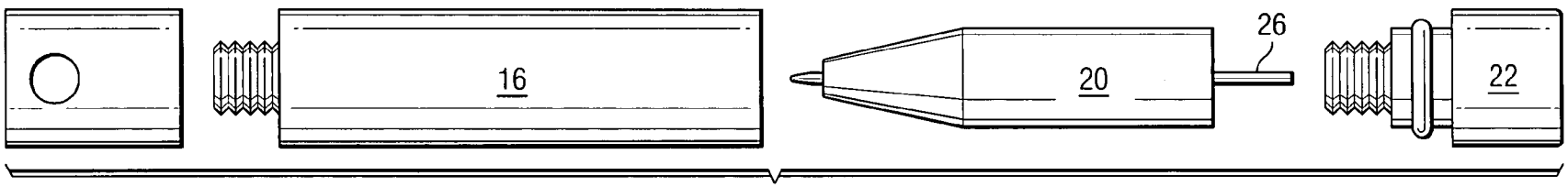
FIG. 3 illustrates four components of the writing instrument.

FIG. 1 illustrates a writing instrument in a collapsed state 11. The writing instrument may be in collapsed state 11, for example, on a key chain. End view 24 shows the writing instrument from one end. FIG. 2 illustrates a quick-use pen 13 of the writing instrument removed from a cap 12. In particular embodiments, cap 12 may be attached to a key chain. Cap 12 may be left attached to the key chain when quick use pen 13 is removed from cap 12. FIG. 3 illustrates four components of the writing instrument. Tubular barrel 16 may include two subcomponents.

Figure 4:
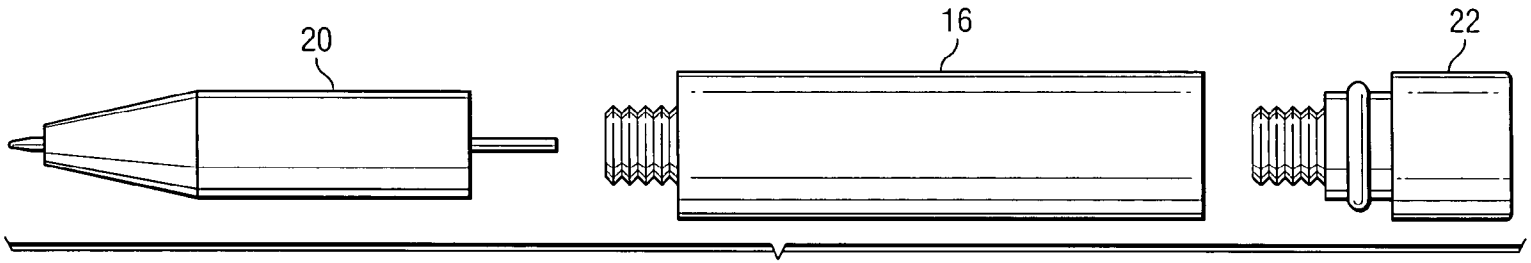
FIG. 4 illustrates assembly of a full-size pen of the writing instrument from three of the components.
Figure 5:
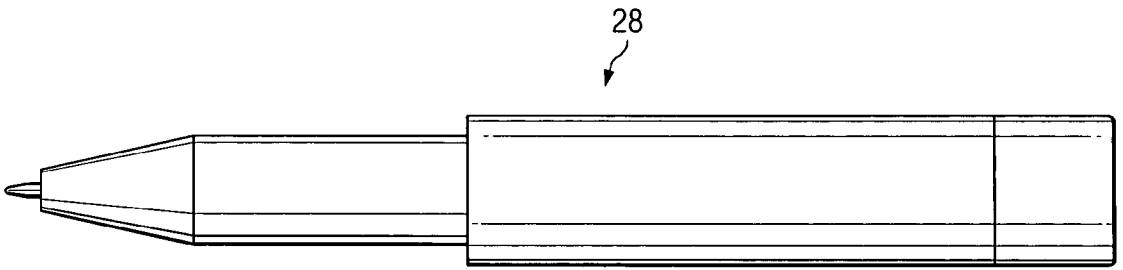
FIG. 5 illustrates the assembled full-size pen.
Figure 6:
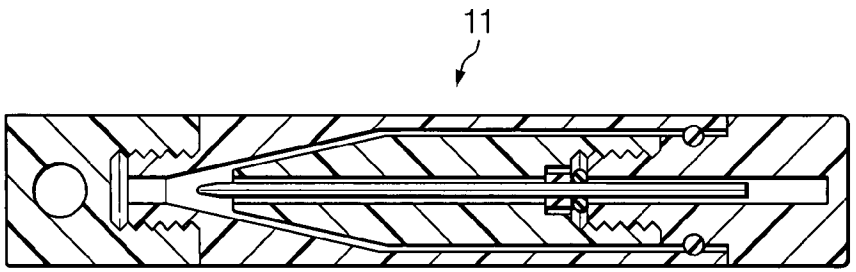
FIG. 6 illustrates a cross section of the writing instrument in the collapsed state.
Figure 7:
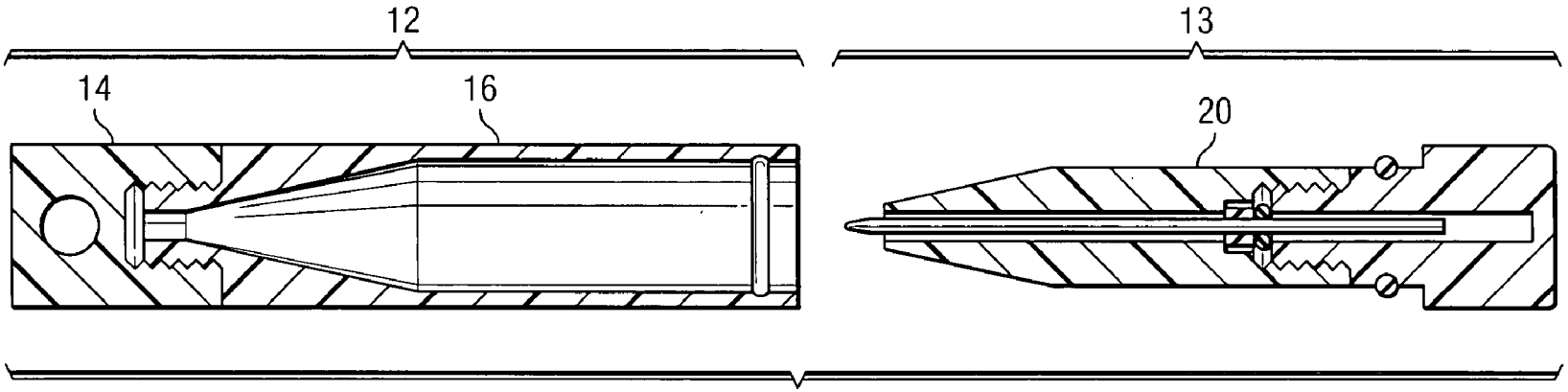
FIG. 7 illustrates a cross section of the quick-use pen removed from the cap.
Figure 8:
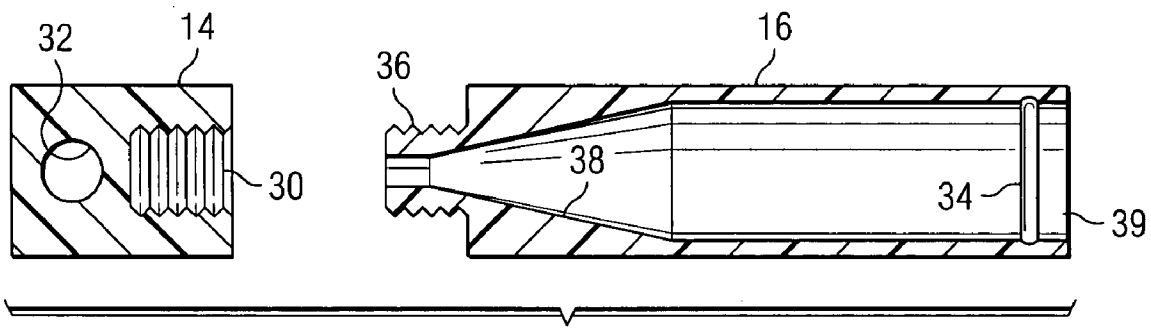
FIG. 8 illustrates a cross section of a key-ring holder and a tubular barrel of the writing instrument.
Figure 9:
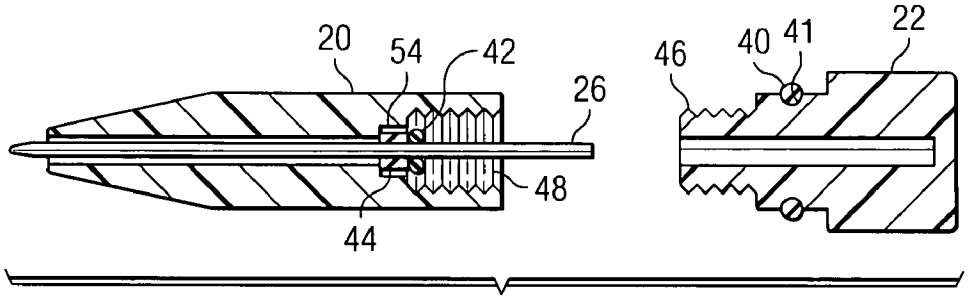
FIG. 9 illustrates a cross section of a pen tip and an end plug of the writing instrument.
Figure 10:
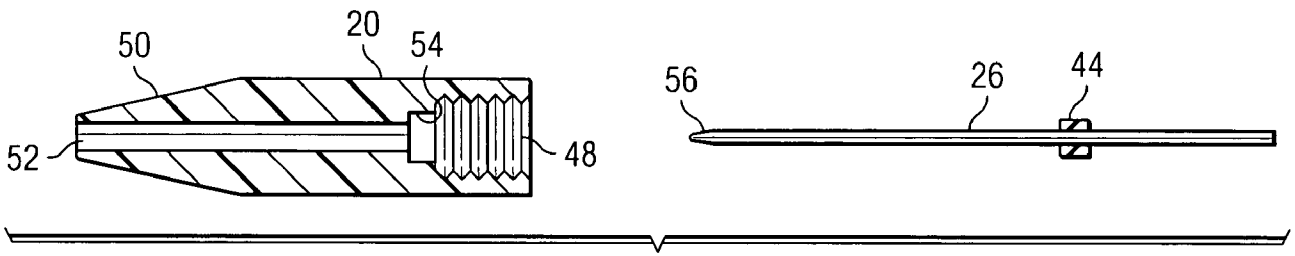
FIG. 10 illustrates a cross section of an ink cartridge removed from the pen tip of the writing instrument.
Figure 11:
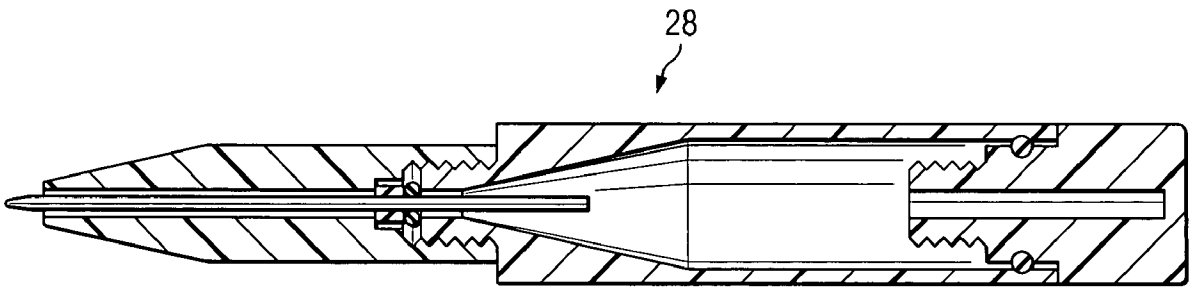
FIG. 11 illustrates a cross section of the assembled full-size pen.

FIG. 4 illustrates assembly of a full-size pen 28 of the writing instrument from three of the components illustrated in FIG. 3. The three components may be rearranged and aligned to assemble full-size pen 28 from the three components. FIG. 5 illustrates assembled full-size pen 28. FIG. 6 illustrates a cross section of the writing instrument in collapsed state 11. FIG. 7 illustrates a cross section of quick-use pen 13 removed from cap 12. FIG. 8 illustrates a cross section of key-ring holder 14 and tubular barrel 16 of the writing instrument. FIG. 9 illustrates a cross section of a pen tip 20 and an end plug 22 of the writing instrument. FIG. 10 illustrates a cross section of an ink cartridge 26 removed from pen tip 20 of the writing instrument. FIG. 11 illustrates a cross section of assembled full-size pen 28.

Key ring holder 14 has a female threaded hole 30 to accept male threads 36 of tubular barrel 16. Key ring holder 14 also has a through hole 32 that may be used to attach key ring holder 14 to a key ring or other device.

Tubular barrel 16, on one end, has male threads 36 and a tapered through hole 38. On the other end, tubular barrel 16 has a tubular opening 39 to accept a tapered end 50 of pen-tip tube 20 when inserted. The inside of tubular opening 39 includes a circumferential groove 34 for an o-ring seal with o-ring 40 on end plug 22 when end plug 22 is inserted into tubular barrel 16 through tubular opening 39 for attachment.

A retaining sleeve 44 is mounted on ink cartridge 26 in a position allowing a writing tip 56 to be exposed with an suitable reveal for ink cartridge 26. An adhesive may hold retaining sleeve 44 in position on ink cartridge 26. An o-ring bushing 42 may slip onto ink cartridge 26 adjacent and behind retaining sleeve 44 where the end of end plug 22 with male threads 46 compresses it slightly and applies a force to hold ink cartridge 26 in a correct position. An o-ring on ink cartridge 26 above retaining sleeve 44 may help to hold ink cartridge 26 in place and may have at least some give or adjustability allowing for varying tolerances during manufacturing, while still helping to hold ink cartridge 26 in place. This o-ring may also give writing tip 56 at least a small amount of cushion when writing.

Pen-tip tube 20 includes a female threaded hole 48 on one end. On the interior of female threaded hole 48, a sleeve hole 54 mounted on ink cartridge 26 accepts retaining sleeve 44. A through hole 52 runs through the entire part. A tapered end 50 is on the other end.

End plug 22 includes male threads 46. End plug 22 also includes an o-ring groove 41 and an o-ring 40 that, when quick-use pen 13 is inserted into tubular barrel 16, mates with the circumferential groove 34 and seals and attaches end plug 22 to tubular barrel 16.

O-ring 40 may fasten end plug 22 to pen-tip tube 20 when arranged as quick-use pen 13. O-ring 40 may also fasten end plug 22 to tubular barrel 16 when arranged as full-size pen 28. O-ring 40 may also provide an environmental seal at end plug 22 when in collapsed state 11.

The previously described components may be assembled into at least four configurations: (1) closed pen 11 as illustrated in FIG. 6; (2) pen cap 12 as illustrated in FIG. 7; (3) quick-use pen 13 as illustrated in FIG. 7; and (4) full-size pen 28 as illustrated in FIG. 11.

Closed pen 11 is the state of the pen system until quick-use pen 13 is desired. In particular embodiments, quick-use pen 13 may then be easily pulled out of pen cap 12 for use and later easily inserted back into pen cap 12 after use by pressing it in by hand.

In particular embodiments, when a full-size pen 28 is desired: (1) quick-use pen 13 may be unplugged from pen cap 12; (2) pen cap 12 may be disassembled by unscrewing tubular barrel 16 from key ring holder 14; (3) end plug 22 may be unscrewed from pen-tip tube 20 with ink cartridge 26 remaining in pen-tip tube 20; (4) the end of tubular barrel 16 with male threads 36 may be screwed into the end of pen-tip tube 20 with female threaded hole 48; and (5) male-threaded end 46 of end plug 22 may be plugged into tubular opening 39 of tubular barrel 16 until o-ring 40 seats in circumferential groove 34 and the two parts are attached. After use or when quick-use pen 13 or closed pen 11 configuration is desired, these steps may be reversed (plugged switched with unplugged and screwed switched with unscrewed). When ink cartridge 26 needs replacement, ink cartridge 26 is pulled from pen-tip tube 20 and a replacement ink cartridge 26 (with a retaining sleeve 44) is inserted.

Although a particular writing instrument is illustrated an described, the present invention contemplates a variety of writing instruments, at least some of which are described below.

Other embodiments use the concept of a shorter pen that stores in its cap and uses the cap to convert to a larger pen regardless whether or not the cap is actually a functioning cap. There could also be an embodiment in which the pen converts into more than two different sizes or states.

The pen could have one or more different size states and also have additional functions it can convert to, or be a subcomponent of including but not limited to: a storage container (i.e. for matches, paper, or pills), a writing instrument(s) and a tool (i.e. knife, screwdriver, wrench, awl), a laser pointer, an electronic device (i.e. recorder), a flashlight (LED or incandescent), and etc. The quick-use pen could be a quick-use flashlight and convert into a pen. There could be a quick-use pen that flipped around or otherwise easily converted to a quick-use pointer (laser or telescopic) or flashlight with or without another pen conversion.

Different materials, sizes, and interconnections can be used for all the components and parts. The materials could vary for different results such as: manufacturing economics, availability of materials, newly developed or available materials, weight reduction, strength and durability, and visual appearance.

Key ring holder 14 does not need to be used for a key ring, or anything else. The hole in the part could be removed. Or the hole could be left in arid used to attach the pen to a necklace, a string, a loop on a bag or backpack, quick release mechanism, or any other object. The shape of key ring holder 14 could change to a variety of shapes including a flat section on the end with the through hole to reduce the space it takes on a key ring and make it easier to put on and remove from the key ring. A spring loaded or other quick release mechanism could be integrated with key ring holder 14 for interfacing with key chains.

End plug 22 could connect with threads in addition to o-ring 40 seal or just threads and no o-ring seal. The other threaded connections could also have o-rings or other type of bushings. The seals would serve as a lock washer to reduce the chance of the threads loosening when not desired and also serve as environmental seals.

Tubular barrel 16 could also attach to end plug 22 and the pen tip without a circumferential groove 34. Quick-use pen 13 could attach to pen cap 12 when in closed pen 11 position with threads in addition to the o-ring, with threads and no o-ring, or with more than one o-ring and circumferential groove (or with one or no grooves).

All the connections could use a quick release or other type of connection instead of the threaded connections and o-ring seal. These connections could rely on compression, spring force and/or friction.

The pen system could be modified to accommodate many different ink cartridges of varying shape, color, type, function and design including but not limited to pencil, felt tip marker and PDA (personal digital assistant) stylus.

The method of holding the ink cartridge in position could use a retaining sleeve 44 fitted to size without an O-ring bushing, the material would be slightly compressive. Retaining sleeve 44 could be attached to the ink cartridge with a compression fitting instead of an adhesive; this would require that the interior dimension of retaining sleeve 44 be slightly smaller than the outer diameter of ink cartridge 26.

The length of the tubular sections of my pen can be made shorter or longer which would result in a shorter or longer quick-use pen 13, full-size pen 28, and collapsed pen 11 to accommodate different applications. Another advantage from my design related to this is that when the length of collapsed pen 11 increases by an amount, the length of full-size pen 28 increases by twice that amount which helps to optimize full-size pen 28 length and compactness of collapsed pen 11.

The ornamental design of the pen could change with different patterns, varying chamfers and radii, and different colors, materials, grooves, grips, and finishes.

A pocket clip could be attached to end plug 22 and would work on both quick-use pen 13, full-size pen 28 and closed pen 11. The pocket clip could be permanent or removable.

The pen could be built in different inner and outer diameters to accommodate different styles and use different size ink cartridge. Or just the outer diameter of the tubular sections could remain the same and the inner diameter could be changed.

Tapered end 50 of pen-tip tube 20 could be a separate piece from the rest of pen-tip tube 20. Having two separate parts could be used to: accommodate different methods to replace ink cartridge 26; allow the pen to use a component (e.g. tapered tip) that is made by another manufacturer; create a different aesthetic appearance that would be more similar to typical pens; create another part that could be desirable to users who enjoy taking the system apart and rebuilding it as novelty gadget; allow users to switch the components with other of version of the pen system that are made of different materials or have different finishes to create a different pen or a pen that is more interesting to the user. The tapered tip can connect to the tubular part with threads or other type of fastener mechanism, compression, or adhesive. The need for two parts could also be to reduce costs in the manufacturing process and possibly reduce the weight of my pen by using tube stock material for the nontapered part of pen-tip tube 20.

Tubular barrel 16 could be manufactured out of two parts, a separate tube and an insert with male threads 36 and tapered hole. The insert could be fastened with threads, adhesive, compression or by another method.

The quick-use pen could be built and used with the cap and key ring holder 14 without the option to convert to full-size pen 28.

The finish colors on the pen could correspond to the color of the ink cartridge. The whole pen could change color or just part of it. The user could purchase a new tip or end plug that would match the ink cartridge color, or a standard colored pen could have a colored tip or other part corresponding to the ink color. The finish colors of the pen could be made with colored anodizes, an oxidation method, a type of baked on color, paint or other method.

In particular embodiments, key ring holder 14 has a circumferential o-ring groove that accepts an o-ring to form a seal when male threads 36 of tubular barrel 16 are screwed into key ring holder 14. This may seal a hole in male threads 36 that allows ink cartridge 26 to pass through when the pen is in the full-size state. It also forms the other o-ring seal in collapsed state 11 so the whole unit is completely sealed. The o-ring of key-ring holder 14 may seal key-ring holder 14 end of the writing instrument when in collapsed state 11. This o-ring may also restraining male threads 36 from inadvertently loosening.

In particular embodiments, end plug 22 has radial grooves or ridges or other type of gripping surface (which may, for example, be rubber) to allow end plug 22 to be pulled out more easily when attached to the quick-use pen or acting as an end plug 22 on the full-size pen.

In particular embodiments, a convertible-multi use writing instrument includes tubular barrel 16 and pen tip 20 and does not have a separate plug end 22. In these embodiments, one or more aspects of plug end 22 may be incorporated into tubular barrel 16, pen tip 20, or both. As an example and not by way of limitation, pen tip 20 may include a closed end opposite a writing end of pen tip 20 without female threaded hole 48. In addition, pen tip 20 may include an o-ring providing similar functionality to o-ring 40 of end-plug 22.

Although the present invention has been described with several embodiments, myriad changes, variations, alterations, transformations, and modifications may be suggested to one skilled in the art, and it is intended that the present invention encompass such changes, variations, alterations, transformations, and modifications as fall within the scope of the appended claims. The present invention is not intended to be limited, in any way, by any statement in the specification that is not reflected in the claims.

What is claimed is:

1. A convertible multi-use writing instrument comprising:
a cap comprising a first end and a second end;
a tip comprising a writing end and a fastening end opposite the writing end; and
a plug;
the cap being operable to encapsulate at least the writing end of the tip to facilitate providing a quick-use arrangement;
the fastening end of the tip being:
fastenable to the plug to facilitate providing the quick-use arrangement; and
fastenable to the first end of the cap to facilitate providing a full-size arrangement; and
the second end of the cap being fastenable to the plug to facilitate providing the full-size arrangement;
wherein:
the fastening end of the tip comprises female threading;
the first end of the cap comprises male threading;
the plug comprises male threading and an o-ring;
to facilitate providing the quick-use arrangement:
the fastening end of the tip is fastenable to the plug using the female threading of the fastening end of the writing tip and the male threading of the plug; and
the o-ring of the plug is operable to secure the tip in the cap when the tip is encapsulated in the cap; and
to facilitate providing the full-size arrangement:
the fastening end of the tip is fastenable to the first end of the cap using the female threading of the fastening end of the tip and the male threading of the first end of the cap; and
the second end of the cap is fastenable to the plug using the o-ring of the plug.

2. The convertible multi-use writing instrument of claim 1, wherein the o-ring of the plug provides an environmental seal when the tip is encapsulated in the cap.

3. The convertible multi-use writing instrument of claim 1, wherein the fastening end of the tip is operable to receive an ink cartridge, a retaining sleeve and a bushing of the ink cartridge securing the ink cartridge inside the tip.

4. A convertible multi-use writing instrument comprising:
a cap comprising a first end and a second end;
a tip comprising a writing end and a fastening end opposite the writing end;
a plug; and
a key-ring holder, the key-ring holder being fastenable to the first end of the cap to facilitate providing the quick-use arrangement;
the cap being operable to encapsulate at least the writing end of the tip to facilitate providing a quick-use arrangement;
the fastening end of the tip being:
fastenable to the plug to facilitate providing the quick-use arrangement; and
fastenable to the first end of the cap to facilitate providing a full-size arrangement; and
the second end of the cap being fastenable to the plug to facilitate providing the full-size arrangement.

5. The convertible multi-use writing instrument of claim 4, wherein the key-ring holder comprises female threading, the key-ring holder being fastenable to the first end of the cap using the female threading of the key-ring holder and the male threading of the first end of the cap to facilitate providing the quick-use arrangement.

6. The convertible multi-use writing instrument of claim 5, wherein the key-ring holder further comprises an o-ring providing an environmental seal when the key-ring holder is fastened to the first end of the cap to provide the quick-use arrangement.

7. A convertible multi-use writing instrument comprising:
a cap comprising a first end and a second end; and
a tip comprising a writing end and a fastening end opposite the writing end;
the cap being operable to encapsulate at least the writing end of the tip to facilitate providing a quick-use arrangement; and
the fastening end of the tip being fastenable to the first end of the cap to facilitate providing a full-size arrangement; and
wherein:
the fastening end of the tip comprises female threading;
the first end of the cap comprises male threading; and
the fastening end of the tip is fastenable to the first end of the cap using the female threading of the fastening end of the tip and the male threading of the first end of the cap to facilitate providing the full-size arrangement.

8. The convertible multi-use writing instrument of claim 7, wherein the fastening end of the tip is operable to receive an ink cartridge, a retaining sleeve and a bushing of the ink cartridge securing the ink cartridge inside the tip.

9. A method for a convertable multi-use writing instrument, the method comprising:
encapsulating at least a writing end of a tip in a cap and fastening a fastening end of the tip to a plug to facilitate providing a quick-use arrangement, the writing end of the tip being opposite the fastening end of the tip, the cap comprising a first end and a second end opposite the first end; and
fastening the fastening end of the tip to the first end of the cap and fastening the second end of the cap to the plug to facilitate providing a full-size arrangement;
wherein:
the fastening end of the tip comprises female threading;
the first end of the cap comprises male threading;
the plug comprises male threading and an o-ring; and
the method comprises:
to facilitate providing the quick-use arrangement:
fastening the fastening end of the tip to the plug using the female threading of the fastening end of the writing tip and the male threading of the plug; and
using the o-ring of the plug to secure the tip in the cap when the tip is encapsulated in the cap; and
to facilitate providing the full-size arrangement:
fastening the fastening end of the tip to the first end of the cap using the female threading of the fastening end of the tip and the male threading of the first end of the cap; and
fastening the second end of the cap to the plug using the o-ring of the plug.

10. The method of claim 9, wherein the o-ring of the plug provides an environmental seal when the tip is encapsulated in the cap.

11. The method of claim 9, wherein the fastening end of the tip is operable to receive an ink cartridge, a retaining sleeve and a bushing of the ink cartridge securing the ink cartridge inside the tip.

12. A method for a convertable multi-use writing instrument, the method comprising:
encapsulating at least a writing end of a tip in a cap to facilitate providing a quick-use arrangement, the tip comprising the writing end and a fastening end opposite the writing end, the cap comprising a first end and a second end opposite the first end; and fastening the fastening end of the tip to the first end of the cap to facilitate providing a full-size arrangement; wherein:

the fastening end of the tip comprises female threading;

the first end of the cap comprises male threading; and the method comprises fastening the fastening end of the tip to the first end of the cap using the female threading of the fastening end of the tip and the male threading of the first end of the cap to facilitate providing the full-size arrangement.

13. The method of claim 12, wherein the fastening end of the tip is operable to receive an ink cartridge, a retaining sleeve and a bushing of the ink cartridge securing the ink cartridge inside the tip.

* * * * *